US005328529A

United States Patent [19]

Cordea et al.

[11] Patent Number: 5,328,529

[45] Date of Patent: Jul. 12, 1994

[54] HIGH STRENGTH AUSTENITIC STAINLESS STEEL HAVING EXCELLENT GALLING RESISTANCE

[75] Inventors: James N. Cordea, West Chester; William J. Scumacher, Monroe, both of Ohio; Harshad V. Sheth, Rancho Palos Verdes, Calif.; Mark J. Gore, West Chester, Ohio

[73] Assignee: Armco Inc., Middletown, Ohio

[21] Appl. No.: 36,790

[22] Filed: Mar. 25, 1993

[51] Int. Cl.[5] ..... C22C 38/34; C22C 38/46

[52] U.S. Cl. ..... 148/327; 420/59

[58] Field of Search ..... 148/327; 420/59

[56] References Cited

U.S. PATENT DOCUMENTS

| | | | |
|---|---|---|---|
| 3,075,839 | 0/1963 | Dulis et al. | 75/125 |
| 3,112,195 | 11/1963 | Souresney | 75/126 |
| 3,151,979 | 10/1964 | Carney et al. | 75/128 |
| 3,806,337 | 4/1974 | Jones | 75/125 |
| 3,912,503 | 10/1975 | Schumacer et al. | 75/125 |
| 3,940,266 | 2/1976 | Goller et al. | 75/128 A |
| 4,337,088 | 6/1982 | Moses | 75/128 |
| 4,502,886 | 3/1985 | Cordea et al. | 75/125 |
| 4,514,236 | 4/1985 | Cook et al. | 148/38 |
| 4,523,951 | 6/1985 | Andreini et al. | 75/126 B |
| 4,818,484 | 4/1989 | DeBold et al. | 420/46 |
| 4,822,556 | 4/1989 | Cordea et al. | 420/59 |
| 4,840,768 | 6/1989 | Damiam et al. | 420/582 |
| 5,094,812 | 3/1992 | Dulmaine et al. | 420/57 |
| 5,147,475 | 9/1992 | Holmberg | 148/327 |

FOREIGN PATENT DOCUMENTS

| | | | |
|---|---|---|---|
| 58-107477 | 6/1983 | Japan | 420/59 |

*Primary Examiner*—Deborah Yee

*Attorney, Agent, or Firm*—Larry A. Fillnow; Robert J. Bunyard; Robert H. Johnson

[57] ABSTRACT

A nonmagnetic austenitic stainless steel and articles produced therefrom, such as drill collars, having a 0.2% yield strength of at least 690 N/mm$^2$ (100 ksi), excellent resistance to intergranular stress corrosion, good ductility, good corrosion resistance, very low magnetic permeability (less than 1.004) and resistance to galling and wear which is typically at least 50% better than found in previous drill collars, the steel and articles consisting essentially of, in weight percent, from greater than 0.05% to about 0.10% carbon, greater than 18% to about 22% manganese, about 12.5% to about 17% chromium, about 1.5% to about 5% nickel, about 0.2% to about 0.4% nitrogen, about 0.2% to about 0.7% vanadium, about 1% maximum copper, about 1% maximum molybdenum, about 2% to about 4% silicon, about 0.05% maximum phosphorus, about 0.03% maximum sulfur and balance essentially iron.

10 Claims, No Drawings

HIGH STRENGTH AUSTENITIC STAINLESS STEEL HAVING EXCELLENT GALLING RESISTANCE

BACKGROUND OF THE INVENTION

This invention relates to nonmagnetic, austenitic, stainless steels which are balanced in composition to provide high yield strength in the hot worked, forged or cold worked condition, improved resistance to galling, good resistance to intergranular stress corrosion cracking and good general corrosion resistance. The steels are particularly suited for the production of down-hole stabilizers and drill collars fabricated therefrom.

In view of the considerable depths to which the average oil fields are drilled, the requirements for the tubular alloys have changed dramatically over the years. The materials must withstand greater stresses and are required to have greater strength levels. Deeper drilling has required the use of sensitive measuring equipment to ensure the desired course of drilling is being maintained. This requires the alloy to be completely nonmagnetic to avoid any interference with the instruments. At these greater depths, the steels have encountered very aggressive chloride and sulfide environments which has required alloy modifications to improve resistance to stress corrosion cracking. The drill collars have threaded connections and must also possess reasonably good machinability. Drill collar alloys have been continuously improved for various properties while attempting to maintain the previous combination of properties because the loss of one property would make the drill collar unacceptable for use in the industry.

During drilling, the total length of drill pipe down to the drill bit must be regularly withdrawn to substitute new drill bits for the worn members. All of the pipe and drill collar joints must be threaded and disconnected many times over the entire drilling depth. The joints encounter severe conditions which contribute to galling and wear. The make-up torques at drilling sites, in most cases, are excessive and cause premature galling damage at the connections. When these drill collars are returned from the field after a journey or two into the hole (short usage), they must be repaired extensively or the damaged connections removed and new ones remachined on shortened collars. Many users employ short pieces of galling resistant beryllium-copper to minimize the joint damage. However, this alternative is very costly. In order to insure that the relatively expensive threaded drill collars can be used many times before being replaced and minimize any downtime required for making and breaking the connections, the material needs to be able to resist galling and wear.

Galling may be defined as the condition where the friction developed between two rubbing surfaces results in localized welding at the high spots on the surfaces. As more localized welding occurs during the making and breaking of the joints, the metal-to-metal contact results in the destruction of the threads which then require remachining.

The materials used for drill collars have not been modified significantly for the purpose of improving the resistance to wear and galling. This may appear quite surprising when one stops to consider that there has been a great deal of alloy development in austenitic stainless steels to improve these properties. The major explanation for the lack of development work in this area is the influence of alloy changes on the other properties required for these products.

The galling resistance of austenitic stainless steels has been related to many theories. Patents such as U.S. Pat. No. 3,912,503 have modified the surface oxide and increased the work hardening rate with a typical steel having a composition of 16% Cr, 8% Ni, 8% Mn, 4% Si, 0.08% C, 0.15% N and balance essentially iron. This alloy with good galling resistance was also designed to provide good corrosion resistance as a replacement for Type 304 stainless steel. Ni at these levels can impair stress corrosion cracking resistance.

U.S. Pat. No. 3,663,215 relies on hard silicides of Mo, Ti, V or W which are finely dispersed in the matrix to improve wear and galling. These steels have 5–12% Si, 10–22% Cr, from about 5% up to about 10% of the silicide former, 14–25% Ni, up to 0.15% C, less than 0.05% N and balance iron. However, these steels do not have adequate strength for drill collars. They also use high levels of expensive elements like Ni, Mo and W.

U.S. Pat. No. 4,146,412 has excellent galling resistance and has a broad chemistry composition of 13–19% Cr, 13–19% Ni, up to 4% Mn, 3.5–7% Si, up to 0.15% C, less than 0.04% N and balance essentially iron. These steels also have good resistance to stress corrosion cracking and chloride environments but do not have adequate strength for drill collars. Vanadium is restricted to residual amounts because of its strong ferrite forming characteristics and the added cost to balance the alloy with more nickel. Silicon and manganese were believed to lower the stacking fault energy at the planes of atom disarray within the matrix of the steel. Under loading conditions, the lower stacking fault energy promoted the development of numerous stacking faults which produced much greater strain hardening rates in the material. Silicon was believed to diffuse rapidly to points or planes of stress and thereby promote excellent galling resistance.

A standard grade which is regarded as having improved galling resistance is the straight chrome grade known as AISI Type 440C which contains about 16–18% Cr, 1% max Mn, 1% max Si, 0.75% max Mo, about 0.95–1.20% C and remainder iron. This steel is heat hardenable but has poor corrosion resistance, is magnetic and has poor formability.

From the work done previously, it is apparent that the balance between the levels of chromium, manganese, nickel, carbon, nitrogen, silicon and other elements has varied considerably.

Galling resistance in austenitic stainless steels has frequently been improved by the addition of silicon in amounts up to 5% or more. However, a close look at the alloy discussion for drill collar applications will reveal that silicon is a very strong ferrite former and this element has been typically maintained at levels below 1%. The desired composition balance for maintaining a nonmagnetic condition (a magnetic permeability below 1.02 and preferably below 1.004), requires that any increases in silicon be balanced by the addition of austenite stabilizing elements (carbon, manganese, nitrogen or nickel) and/or the reduction of the chromium. This is not an easy matter to resolve since the carbon is controlled to a very low level to avoid intergranular corrosion. Manganese is a weak austenite former but does increase the solubility limit of the alloy for nitrogen. Nitrogen is already at the highest level which can be kept in solution. Nickel is very expensive and is maintained at the lowest level possible which will preserve a low stacking fault energy and provide good resistance to stress corrosion cracking. Lowering the chromium decreases the corrosion resistance. All of these elements are balanced to provide the required levels of strength, magnetic permeability, corrosion resistance, and intergranular corrosion resistance. With all of these requirements, the industry has not made much of an attempt to change the chemistry balance to improve the problems relating to galling and wear in the threaded connections.

Applicants are aware of only two patents which address the problem of galling and wear in drill collar alloys. One is U.S. Pat. No. 4,337,088 which simply thought that any austenitic stainless having good resistance to galling (U.S. Pat. No. 3,912,503) would make a good drill collar alloy and made no changes in the composition of an existing alloy. This steel does not provide the desired level of strength required for these applications. The other austenitic stainless steel developed with good galling properties for the oil drilling applications is U.S. Pat. No. 4,840,768. This patent relates to an expensive, high nickel alloy (27–32%) having high chromium (24–28%), low nitrogen (0.015% max) and low manganese (2% max). The steel has 1.5–2.75% silicon added for improved resistance to stress corrosion cracking, but there is no relationship taught between the silicon and the galling resistance, and there is no discussion on what features of the composition balance provide the improved galling resistance. There is no teaching which relates to a low nickel, high manganese, and high nitrogen alloy with typical chromium contents for these applications and does not suggest how these elements would be balanced.

There is thus a need in the oil drilling business for an austenitic stainless steel which possesses high strength, low magnetic permeability, good corrosion resistance, good resistance to intergranular corrosion and improved resistance to galling and wear. The steels of the invention are well suited for other applications as well.

BRIEF SUMMARY OF THE INVENTION

The present invention has found the composition balance within critical ranges of the essential elements chromium, manganese, nickel, carbon, nitrogen, vanadium and silicon in a ferrous alloy which develops a steel alloy particularly suited for drill collars. The nonmagnetic austenitic steel in the hot-worked or forged condition will have a 0.2% yield strength of at least 690 $N/mm^2$ (100 ksi), and typically greater than 760 $N/mm^2$ (110 ksi), resistance for at least 24 hours in the ASTM A262E test for intergranular corrosion, a magnetic permeability not greater than 1.004 at 500 oersteds and resistance to galling up to a stress level of at least 138 $N/mm^2$ (20 ksi) and preferably at least 170 $N/mm^2$ (25 ksi) when mated against itself. The steels preferably are further characterized by a % reduction in area of at least 40%, a % elongation in 5 cm(2 inches) of at least 25%, a minimum hardness of 290 HBN and a minimum tensile strength of at least 895 $N/mm^2$ (130 ksi). The steels of the invention have been found to provide a galling resistance up to a stress level of at least 138 $N/mm^2$ (20 ksi) when mated with other alloys tested.

The steels of the invention consist essentially of, in weight percent, greater than 0.05% to about 0.10% carbon, greater than about 16% to about 22% manganese, about 12.5% to about 17% chromium, about 0.2% to about 0.4% nitrogen, about 1.5% to about 5% nickel, about 0.2% to about 0.7% vanadium, about 1% maximum copper, about 1% maximum molybdenum, about 2% to about 4% silicon, about 0.05% maximum phosphorus, about 0.03% maximum sulfur and balance essentially iron with minor amounts of unavoidable impurities which do not adversely affect the properties.

It is an object of the present invention to increase the galling resistance of an austenitic stainless steel while maintaining the strength, corrosion resistance, intergranular corrosion resistance and magnetic permeability required for articles such as drill collars used in oil drilling.

It is a feature of the present invention to improve the galling resistance of an austenitic stainless steel by increasing the silicon content and still provide a composition balance which maintains the other required properties for drill collars.

It is an advantage of the present invention that when the threaded connections of drill collars made from the steel of the present invention are made and broken during service, the damage to the threads of the drill collars caused by galling is drastically reduced.

It is a further advantage of the present invention that the composition balance for the steel of the present invention is obtained without the need for large amounts of nickel which would significantly increase the cost.

It is a still further advantage of the present invention that when the composition balance of the steel of the present invention is provided, the material may be processed and fabricated into drill collars with the desired combination of properties.

DESCRIPTION OF THE PREFERRED EMBODIMENTS

Most austenitic stainless steels, which have been developed for improved galling resistance, have not been designed for high strength applications that also require the magnetic permeability of the articles fabricated from the steel to be critically controlled, as in drill collars.

The composition of the present invention is balanced to provide a stable austenitic structure having a significantly improved resistance to galling. The austenitic structure is maintained during all conditions of manufacture and use. The use of vanadium and a controlled combination of carbon and nitrogen results in improved resistance to intergranular attack and sensitization while maintaining excellent strength and a nonmagnetic structure. The desired combination of properties for the steel of the present invention is obtained with the addition of about 2% to about 4% silicon which has provided a galling resistance which is typically at least 50% improved over previous drill collar levels.

Ingots or billets having a composition in accordance with the present invention may be heated to a temperature above 1095° C. (2000° F.) and hot reduced by forging to the desired outside diameter which typically ranges up to about 0.3 meters (1 foot) in diameter and to lengths from about 4.5 meters (15 feet) to over 9 meters (30 feet). The forged material is then trepanned to form the desired bore diameter. Drill collars may also vary in properties depending on the diameter, processing and where the properties are measured. Stress corrosion cracking is reduced if the stress in the drill collars resulting from processing is minimized.

The steel of the invention consists essentially of, in weight percent, greater than 0.05% to about 0.10% carbon, greater than 16% to about 22% manganese, about 12.5% to about 17% chromium, greater than 0.2% to about 0.4% nitrogen, about 1.5% to about 5% nickel, about 0.2% to about 0.7% vanadium, about 1% maximum copper, about 1% maximum molybdenum, about 2% to about 4% silicon, about 0.05% maximum phosphorus, about 0.03% maximum sulfur and balance essentially iron with minor amounts of unavoidable impurities which do not adversely affect the properties. A more preferred chemistry consists essentially of, in weight %, 0.06% to 0.10% carbon, greater than 18% to about 21% manganese, about 14.5% to about 16.5% chromium, about 0.22% to 0.4% nitrogen, about 2% to about 4.6% nickel, about 0.2% to about 0.6% vanadium, up to 1% copper, about 0.5% maximum molybdenum, about 2.5% to about 3.5% silicon, about 0.05% maximum phosphorus, about 0.03% maximum sulfur and balance essentially iron with minor amounts of unavoidable impurities which do not adversely affect the properties Carbon is required for its function as a strong austenite former and its contribution to strength. In order to also provide good resistance to intergranular corrosion, the level of carbon must be balanced to avoid excessive amounts of grain boundary carbides. While carbon in many austenitic stainless steels is normally maintained below 0.03% for excellent resistance to intergranular attack, the present carbon level of above 0.05% to about 0.10% and preferably 0.06% to 0.10% provides good resistance to intergranular corrosion and sensitization while providing high strength and austenite stability. A more preferred level of carbon is from 0.065% to 0.085%. The addition of vanadium to the steels of the present invention will form fine precipitates with the carbon to impede dislocation slip and increase strength. It must also be considered in the balance of the composition that any removal of the carbon (and nitrogen) by the vanadium addition will remove the strong austenite forming and stabilizing effect of the carbon which would have been present if the carbon were in solid solution. Vanadium is also a very strong ferrite former.

Several patents, such as U.S. Pat. No. 4,341,555, U.S. Pat. No. 4,502,886, U.S. Pat. No. 3,645,725 and U.S. Pat. No. 3,926,620 have taught manganese should be restricted to levels below the present range to provide an alloy with good intergranular corrosion resistance. U.S. Pat. No. 4,822,556 taught manganese levels should be restricted to an amount below about 18% to avoid hot shortness when copper is present and to avoid the formation of precipitates which lower the intergranular corrosion resistance. There are many patents including U.S. Pat. No. 4,822,556 which taught that high levels of manganese contribute to the formation of ferrite which is a serious concern for the steels of the present invention. Contrary to this teaching, it is believed by the applicants that manganese will form some austenite but is added primarily to stabilize the austenite and provide the basis for holding large amounts of nitrogen in solution. Manganese greater than 16% and typically greater than 18% is required in the steels of the present invention to keep the nitrogen in solution and stabilize the austenite. The upper limit for manganese is about 22% and preferably about 21%. Contrary to the teachings of U.S. Pat. No. 4,502,886, manganese above 14% does not adversely affect the mechanical properties but allows the levels of strength to be improved because higher nitrogen contents may be kept in solution. U.S. Pat. No. 3,912,503 states that manganese above 16% hurts the composition balance and lowers the general corrosion resistance. Preferably, the manganese in this patent is restricted to a level below 8.5% and this is in combination with an alloy having twice the nickel content of the present invention. The upper limit of manganese in the present invention is restricted to about 22% to minimize the risk of hot shortness when high residual copper is present. Higher levels of manganese also tend to form undesirable precipitates which lower the intergranular corrosion resistance. Higher levels of manganese may also contribute to the presence of ferrite. A preferred range of manganese is from 18.5% to 21% and more preferably from about 19.5% to 20.5%. It is also important to note that the high levels of manganese in the steel of the present invention are also related to the silicon additions used since silicon decreases nitrogen solubility and manganese additions are relied upon to keep the nitrogen in solution. Previous levels of manganese which kept the nitrogen in solution are not acceptable with silicon contents of 2% to 4%. Steels developed in U.S. Pat. No. 3,912,503 were limited to nitrogen contents below about 0.2% with the high level of silicon present. The present invention has increased the amount of nitrogen in solution by increasing the amount of manganese to levels higher than those used in U.S. Pat. No. 3,912,503.

Chromium is present from about 12.5% to 17% to insure good general corrosion resistance. A preferred chromium range of 13% to less than 16% provides the optimum properties when balanced with the other elements in the composition and particularly the higher levels of nitrogen. A more preferred range of chromium is from 13% to 14.5%. Chromium is lower in the steels of the present invention compared to some drill collar alloys in order to maintain the desired austenitic structure and compensate for the increased silicon contents. The lower amounts of chromium in the steels of the present invention must be supplemented with the higher levels of manganese to insure that there is adequate solubility for nitrogen.

Nitrogen is a key element in developing the high strength level of this alloy while stabilizing the austenitic structure. Nitrogen is present from above about 0.2% to about 0.4%. Nitrogen will typically be from 0.22 % to 0.4% and preferably from 0.25% to 0.35%. The level of nitrogen must not exceed the solubility limits of the alloy. The higher than normal levels of manganese allow these higher levels of nitrogen to be in solution with the reduced chromium contents. Since silicon decreases the nitrogen solubility, the level of manganese must be even higher than the amount used to replace chromium for maintaining the nitrogen in solution. The nitrogen solubility limit for galling resistant steels such as taught in U.S. Pat. No. 3,912,503 is about 0.2%. Previous drill collar alloys having high nitrogen contents but low silicon contents have not been faced with the influence of silicon on nitrogen solubility. Nitrogen is also a grain boundary corrosion sensitizing element although not as aggressive as carbon. Achieving complete stabilization for the control of intergranular corrosion involves the consideration of the high levels of nitrogen as well as the carbon. The high levels of nitrogen allow the silicon content to be increased while maintaining an austenitic structure.

Vanadium has been considered with niobium and titanium as a strengthening element but has not been used much because it is not as strong a carbide former as the other elements. Niobium is generally regarded as a better strengthening agent. Strengthening elements must be used with caution in drill collar alloys for several reasons. Niobium, titanium, vanadium, tantalum, zirconium and others are very strong ferrite formers and are usually avoided in a nonmagnetic alloy. Additionally, when these elements combine with carbon or nitrogen, they remove these strong austenite formers and stabilizers from the system which must be rebalanced to insure a nonmagnetic structure. The formation of carbides and nitrides will also remove the ferrite former (Nb, Ti, V, Ta and Zr). The addition of about 0.2% to about 0.7% vanadium, preferably 0.2% to 0.6% and more preferably about 0.25% to about 0.5% provides improved strength properties when balanced properly with manganese and nitrogen additions. Vanadium helps to provide a grain size of ASTM 6 or smaller which improves strength and reduces intergranular stress corrosion. Vanadium carbides and nitrides are very fine and uniformly distributed, as compared to niobium carbides, which are massive and not uniformly distributed. The vanadium addition for optimum results is 0.25% to 0.4% to provide the best balance of grain size, precipitation strengthening, resistance to intergranular stress corrosion, a stable austenitic structure and good forging characteristics.

U.S. Pat. No. 4,822,556 relates to drill collars having a vanadium addition and is incorporated herein by reference.

Nickel is an element normally relied heavily upon for providing an austenitic structure. The upper limit of nickel in this invention is about 5% to maintain sufficient stress corrosion cracking resistance. A minimum level of about 1.5% is required to provide an austenitic structure. A preferred range for nickel is about 2.5% to 4.5%. For the purposes of galling resistance, nickel increases the stacking fault energy and should be minimized. Silicon lowers the stacking fault energy which is favorable for galling resistance. A critical balance of silicon and nickel is necessary to maximize austenite formation stability and resistance to galling. Lower nickel helps to keep the overall cost of the alloy down. With the nitrogen added to the solubility limit of the alloy, the nickel will be added in an amount which is just enough to maintain the alloy completely austenitic.

Molybdenum and copper are commonly present as impurities and are restricted to a maximum of 1.0% and preferably a maximum of 0.75%. Molybdenum may be added to provide additional strengthening but its use will require the addition of austenite formers to maintain the nonmagnetic balance of the alloy since molybdenum is a ferrite former and also tends to remove carbon from solution. While copper is beneficial in forming austenite, stabilizing austenite to resist martensite transformation and lowering the work hardening rate, it could cause a problem with hot shortness due to the high levels of manganese and is thus limited to a maximum of 1%.

The critical magnetic permeability requirement for steels of the present invention makes the addition of silicon a serious concern. Silicon has a very high ferrite forming capability and requires the addition of austenite formers above the existing levels used for drill collars. Silicon is relied upon in the present invention to provide the improved galling resistance, but the addition of silicon requires a rebalancing of the alloy composition. Silicon is critical to the present invention and must be present in an amount greater than about 2% to about 4%. Preferably, the silicon is present in an amount ranging from 2.25% to 3.75% and more preferably from 2.5% to 3.5%. With silicon contents below 2%, the alloy does not possess good galling resistance and at levels higher than 4%, the alloy does not have the desired combination of properties required for drill collars and other articles.

Phosphorus and sulfur are commonly present as impurities. Phosphorus is limited to about 0.05% maximum and sulfur is limited to about 0.03% maximum.

Any one or more of the preferred or more preferred ranges indicated above can be used with any one or more of the broad ranges for the remaining elements in this iron base alloy.

Drill collars produced according to the invention typically will have the following properties determined at the 75% radius position:

1) Magnetic permeability of 1.004 maximum.
2) 0.2% yield strength of 690 $N/mm^2$ (100 ksi ) minimum.
3) Resistance to intergranular attack (as measured by the ASTM A262E test) for at least 24 hours.
4) % elongation in 5 cm (2 inches) of at least 25%.
5) % reduction in area of at least 40%.
6) Resistance to galling up to a stress level of at least 138 $MN/m^2$ (20 ksi) on the surface.

The nonmagnetic alloy of the present invention is particularly suited for down-hole equipment such as drill collars or stabilizers but may be produced into various product forms such as plate, sheet, strip, bar, rod, wire and castings. Applications, while not limiting, include boat shafts and other marine products such as rudders, pump shafts and piston rods. The stainless steel articles have particular utility in applications requiring high strength, austenitic stability under all conditions, and good resistance to intergranular and stress corrosion cracking. The alloy is also well suited for the production of nonmagnetic generator rings.

A series of heats was processed and tested. The compositions for these heats are reported in TABLE 1 and the properties reported in TABLES 2 and 3. The properties were on laboratory plate 1.6 cm (⅝ inch) thick which simulated drill collars fabricated using the forging practice discussed previously. The results represent delayed cooling prior to the last reduction. All of the material was water quenched. The steels of the invention met the desired combination of properties for yield strength, galling resistance, nonmagnetic permeability and resistance to intergranular corrosion. The composition also provided excellent properties for forging as measured by the reduction of area and elongation results.

ASTM A-262 Practice E is a test procedure which is used to detect susceptibility to intergranular corrosion. It is more sensitive than the previously used Strauss test. The test requires the material be immersed for 24 hours in a boiling solution of 10% sulfuric acid - 10% copper sulfate solution while the test sample is in contact with metallic copper. After exposure for 24 hours, the samples are bent 180° and visually examined for intergranular cracking. All of the steels of the invention containing vanadium within the range of the present invention and carbon below 0.11% passed the ASTM A262E test for good resistance to intergranular corrosion.

TABLE 1

| | STAINLESS STEEL COMPOSITIONS (WEIGHT %) | | | | | | | | | |
|---|---|---|---|---|---|---|---|---|---|---|
| Heat | % C | % Mn | % Ni | % N | % Cr | % V | % Si | % Cu | % Mo | % Fe |
| 1 | .150 | 10.5 | 2.03 | 0.27 | 13.4 | 0.47 | 2.63 | 0.76 | 0.40 | BAL. |
| 2 | .067 | 15.1 | 2.07 | 0.34 | 13.4 | 0.50 | 2.52 | 0.77 | 0.44 | BAL. |
| 3 | .064 | 17.7 | 2.09 | 0.37 | 13.5 | 0.50 | 2.60 | 0.77 | 0.40 | BAL. |
| 4* | .081 | 19.8 | 2.07 | 0.38 | 13.5 | 0.52 | 2.48 | 0.76 | 0.40 | BAL. |
| 5* | .070 | 19.6 | 2.08 | 0.32 | 13.7 | 0.37 | 2.72 | 0.42 | 0.31 | BAL. |
| 6* | .076 | 19.9 | 2.09 | 0.32 | 13.6 | 0.35 | 2.81 | 0.42 | 0.30 | BAL. |
| 7* | .080 | 20.1 | 2.09 | 0.27 | 13.4 | 0.37 | 2.89 | 0.42 | 0.30 | BAL. |
| 8 | .083 | 21.0 | 2.06 | 0.48 | 13.6 | 0.34 | 3.02 | 0.61 | 0.40 | BAL. |
| 9 | .054 | 20.2 | 2.14 | 0.44 | 13.5 | 0.35 | 3.50 | 0.61 | 0.40 | BAL. |
| 10 | .079 | 13.6 | 4.60 | 0.31 | 17.8 | 0.05 | 3.80 | <.01 | <.01 | BAL. |
| 11 | .081 | 14.2 | 4.52 | 0.27 | 17.5 | 0.02 | 3.85 | <.01 | <.01 | BAL. |
| 12 | .082 | 20.4 | 4.60 | 0.28 | 16.1 | 0.01 | 3.60 | RES. | RES. | BAL. |
| 13* | .076 | 20.3 | 4.60 | 0.28 | 16.2 | 0.30 | 3.60 | RES. | RES. | BAL. |
| 14 | .080 | 14.6 | 3.10 | 0.26 | 16.7 | 0.32 | 2.92 | 0.52 | 0.34 | BAL. |
| 15 | .079 | 15.2 | 3.10 | 0.27 | 16.7 | 0.33 | 3.11 | 0.52 | 0.31 | BAL. |
| 16 | .083 | 15.2 | 3.06 | 0.30 | 16.6 | 0.36 | 3.08 | 0.52 | 0.30 | BAL. |
| 17 | .069 | 15.3 | 3.05 | 0.31 | 16.6 | 0.30 | 3.28 | 0.51 | 0.31 | BAL. |
| 18 | .079 | 15.1 | 4.04 | 0.28 | 16.6 | 0.36 | 3.24 | 0.32 | 0.30 | BAL. |
| 19 | .070 | 15.2 | 2.13 | 0.43 | 17.3 | 0.34 | 0.48 | 0.50 | 0.20 | BAL. |
| 20## | .070 | 8.22 | 8.18 | 0.13 | 16.4 | RES. | 3.96 | 0.41 | 0.20 | BAL. |
| 21 | .066 | 15.0 | 3.97 | 0.26 | 16.5 | 0.36 | 3.07 | 0.30 | 0.30 | BAL. |
| 22 | .075 | 15.9 | 4.09 | 0.25 | 16.4 | 0.34 | 3.27 | 0.43 | 0.31 | BAL. |
| 23* | .075 | 17.0 | 4.10 | 0.22 | 16.4 | 0.33 | 3.21 | 0.43 | 0.31 | BAL. |
| 24* | .086 | 20.2 | 4.18 | 0.26 | 16.0 | 0.35 | 3.40 | 0.42 | 0.31 | BAL. |
| 25# | .070 | 15.0 | 2.00 | 0.42 | 16.5 | 0.36 | 0.50 | 0.50 | RES. | BAL. |
| 26 | .073 | 14.9 | 3.04 | 0.33 | 16.6 | 0.35 | 3.21 | 0.51 | 0.31 | BAL. |

* = STEELS OF THE INVENTION
# = STEEL OF US 4,822,556
RES. = RESIDUAL
## = STEEL OF US 3,912,503
BAL. = BALANCE EXCEPT NORMAL RESIDUAL ELEMENTS

The steels of TABLE 1 were examined for mechanical properties, corrosion resistance, hardness and magnetic permeability. The soundness of the cast material was also checked for nitrogen porosity to see if the allow was also balanced to enable the nitrogen to stay in solution. The results of these properties are shown in TABLE 2 and TABLE 3. Heats 1-3, 8-10 and 26 were gassy and not processed. Heat 16 was slightly gassy.

TABLE 2

| | | MECHANICAL PROPERTIES | | | | | | | |
|---|---|---|---|---|---|---|---|---|---|
| Heat | Gassy | YS KSI | TS KSI | % EL | % RA | Hard. HBN | Mag. Perm. 500 Oerst. | A262E | Gall. Stress KSI Self/L80 |
| 1 | Yes | | | | | | | | |
| 2 | Yes | | | | | | | | |
| 3 | Yes | | | | | | | | |
| 4* | No | 112 | 143 | 30 | 51 | 302 | 1.002 | Pass | 27/27 |
| 5* | No | | | | | | 1.002 | Pass | 28 |
| 6* | No | | | | | 318 | 1.002 | Pass | |
| 7* | No | | | | | 318 | 1.002 | Pass | |
| 8 | Yes | | | | | | | | |
| 9 | Yes | | | | | | | | |
| 10 | Yes | | | | | | >1.1 | | 39 |
| 11 | No | 127 | 150 | 28 | 34 | 353 | 1.024 | Pass | 39 |
| 12 | No | 108 | 137 | 43 | 67 | 289 | 1.001 | Pass | 34 |
| 13* | No | 122 | 146 | 34 | 54 | 311 | 1.002 | Pass | 33/39 |
| 14 | No | 113 | 140 | 40 | 63 | 292 | | | |
| 15 | No | 113 | 140 | 38 | 61 | 311 | >1.01 | | |
| 16 | Slight | 120 | 147 | 38 | 58 | 306 | 1.015 | | |
| 17 | No | 114 | 143 | 39 | 60 | 306 | 1.06 | | |
| 18 | No | | | | | 315 | <1.05 | | |
| 19 | No | 117 | 143 | 33 | | 297 | 1.002 | Pass | |
| 20## | NO | 96 | 127 | 37 | 61 | 279 | 1.003 | | 41 |
| 21 | No | | | | | 307 | 1.03 | | 34 |
| 22 | Split | | | | | | | | |
| 23* | No | | | | | 318 | 1.002 | Pass | 32 |
| 24* | No | | | | | 318 | 1.002 | Pass | 28 |
| 25# | No | >100 | >130 | >25 | >40 | >285 | 1.003 | Pass | 15/4 |
| 26 | Yes | | | | | | | | |

L80 is a carbon steel used in the oil industry for casing and tubing. It typically has about 0.2%-0.25% carbon and in the quenched and tempered condition has about a 550N/m$^2$ (80 ksi) yield strength.

The importance of the addition of vanadium is clearly shown by comparing Heat 13 with Heat 12. The addition of 0.30% vanadium in Heat 13 provided a significant improvement in yield strength enabling the steel of the invention to exceed the minimum required yield strength level of 690 MN/m$^2$ (100 ksi ) whereas Heat 12 with 0.01% vanadium produced a significantly lower minimum yield strength. Heat 12 was not considered a steel of the invention because the properties were developed on plate samples and the addition of at least 0.2% vanadium is believed to be required to consistently develop the required minimum properties.

A study was made to determine the amount of nitrogen which could be added to increase the strength of the drill collar alloy. In this study the nickel was maintained at about 2% and the chromium was held at about 13.5%. The manganese was adjusted between 10% and 21% to determine the effect on the austenitic structure and nitrogen solubility. The silicon was maintained between 2% and 4% to provide the improved galling resistance. The higher nitrogen containing heats (greater than about 0.4%) were porous, especially when the manganese contents were below about 19%. At low levels of manganese (Heat 1 ), porosity was a problem even at 0.27% nitrogen. When manganese was increased to about 19% to 21%, nitrogen solubility was increased and nitrogen levels as high as 0.38% (Heat 4) did not develop porosity problems. These higher manganese levels also promoted very stable austenitic structures having magnetic permeabilities of about 1,002. The results of this study revealed that higher levels of manganese were required to maintain the austenitic structure and that an austenitic alloy which was economical to melt and process would provide adequate properties for drill collars. An improved chemistry with slightly higher nickel and chromium would provide better properties but at a higher melt cost. It is to be noted that the results from the 3% silicon heat (Heat 21) provided an unacceptable magnetic permeability and helped to establish the critical need for manganese contents of greater than 16%. Even though the material had 0.26% N and 3.97% Ni, the balance with 16.46% Cr and 15% Mn produced a permeability of 1.03 at 500 oersteds which is unacceptable for drill collars. One can easily see from this data that the combination of properties is critical to control and that one can not change the composition with the thought of enhancing a single property, such as galling resistance (Heat 21), without balancing the chemistry in consideration for the other properties of interest. Although the magnetic permeability for Heat 14 was not determined, it was assumed that the material would behave very similar to Heat 15 and would not have a permeability within the required range.

The results shown in TABLE 3 show the delicate balance required to insure that the nitrogen present remains in solution and does not cause a gassy condition due to nitrogen evolution. The only heats above which did not have a serious nitrogen porosity problem were Heats 4, 5, 6, 7 and 17. While it is desired to increase the amount of nitrogen to the highest possible level without having a porosity problem, the above heats show that very high levels of manganese are required for the low levels of chromium used with the steels of the present invention in order to keep the nitrogen in solution. Higher levels of chromium promote the formation of chromium nitrides and cause a higher permeability. The differences between Heats 3 and 4 are very slight and show that for a nitrogen content of 0.37% or 0.38%, a level of manganese above 17.7% is required to keep the nitrogen in solution for steels having from 2.48% to 2.60% silicon. One can also see from a comparison between Heat 8 and Heat 4 that a reduction in silicon from 3.02% to 2.48% could be critical in keeping the nitrogen in solution even with manganese contents above 20% with the chromium levels of the present invention for high nitrogen near about 0.4%.

TABLE 3

NITROGEN POROSITY (WEIGHT %)

| Heat | % C | % Mn | % Si | % Cr | % Ni | % Cu | % V | % N |
|---|---|---|---|---|---|---|---|---|
| 1 | 0.150 | 10.46 | 2.63 | 13.41 | 2.03 | 0.76 | 0.47 | 0.27 P |
| 2 | 0.067 | 15.03 | 2.52 | 13.44 | 2.07 | 0.77 | 0.50 | 0.34 P |
| 3 | 0.064 | 17.68 | 2.60 | 13.53 | 2.09 | 0.77 | 0.50 | 0.37 P |
| 4 | 0.081 | 19.84 | 2.48 | 13.53 | 2.07 | 0.76 | 0.52 | 0.38 OK |
| 5* | 0.070 | 19.64 | 2.72 | 13.70 | 2.08 | 0.42 | 0.37 | 0.32 OK |
| 6* | 0.076 | 19.92 | 2.81 | 13.61 | 2.09 | 0.42 | 0.35 | 0.32 OK |
| 7* | 0.080 | 20.09 | 2.89 | 13.39 | 2.09 | 0.42 | 0.37 | 0.27 OK |
| 8 | 0.083 | 20.99 | 3.02 | 13.62 | 2.06 | 0.61 | 0.34 | 0.48 P |
| 9 | 0.054 | 20.20 | 3.50 | 13.63 | 2.14 | 0.61 | 0.35 | 0.44 P |
| 16 | 0.083 | 15.2 | 3.08 | 16.6 | 3.06 | 0.52 | 0.36 | 0.30 P* |
| 17 | 0.069 | 15.3 | 3.28 | 16.6 | 3.05 | 0.51 | 0.30 | 0.31 OK |
| 26 | 0.073 | 14.9 | 3.21 | 16.6 | 3.04 | 0.51 | 0.35 | 0.33 P |

P=Porosity Problems; P*=Only A Slight Porosity Problem; ok=no porosity

Within the preferred ranges of the present invention, there were identified two groups of alloys which provide excellent combinations of properties for drill collars and other related articles. One preferred chemistry (Heats 4–7) for less corrosive environments consists essentially of, in weight percent, from greater than 0.05% to about 0.10% carbon, greater than 18% to about 22% manganese, about 12.5% to about 15% chromium, about 1.5% to about 3% nickel, about 0.2% to about 0.4% nitrogen, about 0.2% to about 0.7% vanadium, about 1% maximum copper, about 1% maximum molybdenum, about 2% to about 3% silicon, about 0.05% maximum phosphorus, about 0.03% maximum sulfur and the balance essentially iron. This steel is basically a low nickel version balanced with low silicon and low chromium to provide an economical alloy with a good balance of properties along with improved galling and wear resistance.

A second alloy (Heats 13 and 24) for use in more corrosive environments has a chemistry which consists essentially of, in weight percent, from greater than 0.05% to about 0.10% carbon, greater than 18% to about 22% manganese, about 15% to about 17% chromium, about 3% to about 5% nickel, about 0.2% to about 0.4% nitrogen, about 0.2% to about 0.7% vanadium, about 1% maximum copper, about 1% maximum molybdenum, about 3% to about 4% silicon, about 0.05% maximum phosphorus, about 0.03% maximum sulfur and the balance essentially iron. This alloy is a higher chromium and silicon alloy balanced with higher nickel to provide a good combination of properties including improved resistance to wear and galling.

While the invention has been described primarily with reference to the production of nonmagnetic drill collars, it will be understood that the invention has utility for other applications requiring a combination of strength, resistance to intergranular stress corrosion, freedom from magnetic effects and good galling resistance. Modifications to the alloys shown may be made by those skilled in the art without departing from the spirit of the invention. Accordingly, no limitations are to be inferred except as set forth in the appended claims.

We claim:

1. An austenitic stainless steel having a 0.2% yield strength of at least 690 N/mm$^2$ (100 ksi), a magnetic permeability not greater than 1.004 at 500 oersteds, acceptable intergranular corrosion resistance as measured by ASTM A-262 Practice E and a resistance to galling up to a stress level of at least 138 N/mm$^2$ (20 ksi) when self mated, said steel consisting essentially of, in weight percent, from greater than 0.05% to about 0.10% carbon, greater than 16% to about 22% manganese, about 12.5% to about 17% chromium, about 1.5% to about 5% nickel, about 0.2% to about 0.4% nitrogen, about 0.2% to about 0.7% vanadium, about 1% maximum copper, about 1% maximum molybdenum, greater than 2% to about 4% silicon, about 0.5% maximum phosphorus, about 0.03% maximum sulfur and balance essentially iron.

2. The steel claimed in claim 1, consisting essentially of, greater than 0.5% to 0.10% carbon, greater than 18% to about 21% manganese, about 14.5% to about 16.5% chromium, about 0.22% to about 0.4% nitrogen, about 2% to about 4.6% nickel, about 0.2% to about 0.6% vanadium, about 1% maximum copper, about 1% maximum molybdenum, about 2.5% to about 3.5% silicon, about 0.05% maximum phosphorus, about 0.03% maximum sulfur and balance essentially iron with minor amounts of unavoidable impurities which do not adversely affect the properties.

3. The steel claimed in claim 1, consisting essentially of, greater than 2% to about 3% silicon, about 12.5% to about 15% chromium and about 1.5% to about 3% nickel.

4. The steel claimed in claim 1, consisting essentially of about 3% to about 4% silicon, about 15% to about 17% chromium and about 3% to about 5% nickel.

5. A nonmagnetic drill collar produced by hot forging an austenitic stainless steel consisting essentially of, in weight %, greater than 0.05% to about 0.10% carbon, greater than 16% to about 22% manganese, about 12.5% to about 17% chromium, about 1.5%. to about 5% nickel, about 0.2% to about 0.4% nitrogen, about 0.2% to about 0.7% vanadium, about 1% maximum copper, about 1% maximum molybdenum, greater than 2% to about 4% silicon, about 0.05% maximum phosphorus, about 0.03% maximum sulfur and balance essentially iron with said collar having a 0.2% yield strength of at least 690% N/mm$^2$ (100 ksi), a magnetic permeability not greater than 1.004 at 500 oersteds, a resistance to galling up to a stress level of at least 138 N/mm$^2$ (20 ksi) when self mated and acceptable intergranular corrosion resistance as measured by the ASTM A-262 Practice E test.

6. The nonmagnetic drill collar claimed in claim 5, consisting essentially of, in weight %, greater than 0.05% to 0.10% carbon, greater than 18% to about 21% manganese, about 14.5% to about 16.5% chromium, about 0.22% to about 0.4% nitrogen, about 2% to about 4.6% nickel, about 0.2% to about 0.6% vanadium, about 1% maximum copper, about 1% maximum molybdenum, about 2.5% to about 3.5% silicon, about 0.05% maximum phosphorus, about 0.03% maximum sulfur and balance essentially iron with minor amounts of unavoidable impurities which do not adversely affect the properties.

7. The nonmagnetic drill collar claimed in claim 5 consisting essentially of from greater than 2% to about 3% silicon, about 12.5% to about 15% chromium and about 1.5% to about 3% nickel.

8. The drill collar claimed in claim 5 consisting essentially of about 3% to about 4% silicon, about 15% to about 17% chromium and about 3% to about 5% nickel.

9. Stainless steel plate, sheet, strip, bar, rod, wire and forgings exhibiting acceptable resistance to intergranular failure as measured by the ASTM A-262 Practice E test, having a magnetic permeability of less than 1.004 at 500 oersteds, having a 0.2% yield strength of at least 690 N/mm$^2$ (100 ksi), freedom from harmful carbides and nitrides at the grain boundaries, and a resistance to galling up to a stress level of at least 138 N/mm$^2$ (20 ksi) when self mated, said stainless steel consisting essentially of, in weight %, greater than 0.05% to about 0.10% carbon, greater than 16% to about 22% manganese, about 12.5% to about 17% chromium, about 1.5% to about 5% nickel, about 0.2% to about 0.4% nitrogen, about 0.2% to about 0.7% vanadium, about 1% maximum copper, about 1% maximum molybdenum, greater than 2% to about 4% silicon, about 0.5% maximum phosphorus, about 0.03% maximum sulfur and balance essentially iron.

10. An austenitic stainless steel having a 0.2% yield strength of at least 690 N/mm$^2$ (100 ksi), a magnetic permeability not greater than 1.004 at 500 oersteds, acceptable intergranular corrosion resistance as measured by ASTM A-262 Practice E and a resistance to galling up to a stress level of at least 138 N/mm2 (20 ksi) when self mated, said steel consisting essentially of, in weight percent, from greater than 0.05% to about 0.10% carbon, greater than 16% to about 22% manganese, about 12.5% to about 17% chromium, about 1.5% to about 5% nickel, about 0.2% to about 0.4% nitrogen, about 0.2% to about 0.7% vanadium, about 1% maximum copper, about 1% maximum molybdenum, 2.25% to 3.75% silicon, about 0.05% maximum phosphorus, about 0.03% maximum sulfur and balance essentially iron.

* * * * *